US007144175B2

(12) United States Patent
Biegel

(10) Patent No.: US 7,144,175 B2
(45) Date of Patent: Dec. 5, 2006

(54) APPLICATOR DEVICE

(75) Inventor: Friedrich Biegel, Nuremberg (DE)

(73) Assignee: Schwan-Stabilo Cosmetics GmbH & Co. KG, Heroldsberg (DE)

( * ) Notice: Subject to any disclaimer, the term of this patent is extended or adjusted under 35 U.S.C. 154(b) by 0 days.

(21) Appl. No.: 11/181,171

(22) Filed: Jul. 13, 2005

(65) Prior Publication Data

US 2006/0222444 A1 Oct. 5, 2006

(30) Foreign Application Priority Data

Mar. 30, 2005 (DE) ..... 10 2005 014 468

(51) Int. Cl.
*B43K 23/08* (2006.01)
*B43K 5/06* (2006.01)

(52) U.S. Cl. ..... 401/213; 401/172; 401/176

(58) Field of Classification Search ..... 401/213, 401/245, 246, 247, 171–174, 176, 179, 180, 401/182

See application file for complete search history.

(56) References Cited

U.S. PATENT DOCUMENTS 1,865,325 A 8/1930 MacLeod
2,258,841 A * 10/1941 Jozsef ..... 401/194
2,536,924 A * 1/1951 Fehling ..... 401/169

FOREIGN PATENT DOCUMENTS

| | | |
|---|---|---|
| DE | 1 817 040 | 8/1960 |
| DE | 698 05 778 | 3/2003 |
| EP | 1 445 121 | 8/2004 |
| GB | 597143 | 9/1945 |

* cited by examiner

*Primary Examiner*—David J. Walczak
*Assistant Examiner*—Huyen Le
(74) *Attorney, Agent, or Firm*—Bachman & LaPointe, P.C.

(57) ABSTRACT

An applicator device comprising a casing, a storage compartment for a product to be applied, an application element comprising a ball held rotatably in a ball holder, a sealing element which is displaceable along a predetermined path between a first position with respect to the casing in which it bears sealingly against the ball and a second position with respect to the casing in which it releases the ball for application of the product, and an increased pressure-producing device for producing an increased pressure in the storage compartment, wherein the sealing element is coupled in a predetermined portion of the path to the increased pressure-producing device. The sealing element is independent of the increased pressure-producing device in a first portion of the path which is delimited by the first position.

13 Claims, 6 Drawing Sheets

A-A

APPLICATOR DEVICE

BACKGROUND OF THE INVENTION

The invention relates to an applicator device comprising a casing, a storage means for a product to be applied, an application means comprising a ball held rotatably in a ball holder, a sealing means which is displaceable along a predetermined path between a first position with respect to the casing in which it bears sealingly against the ball and a second position with respect to the casing in which it releases the ball for application of the product, and an increased pressure-producing means for producing an increased pressure in the storage means, wherein the sealing means is coupled in a predetermined portion of the path to the increased pressure-producing means.

Applicator devices are known, for example from EP 1 445 121 A1.

As the sealing means in the above-mentioned first position bears sealingly against the ball, it urges the ball into the ball holder in such a way that a gap is produced between the ball holder and the ball, through which gap the product to be applied can issue as soon as an increased pressure obtains in the storage means. As, in the known applicator devices, the predetermined portion of the path of the sealing means from the first position into the second position, that is to say that portion of the path in which the sealing means is coupled to the increased pressure-producing means, directly adjoins the first position, an increased pressure is produced in the storage means while the ball is still being urged into the ball holder by the sealing means, for which reason there is the risk of the product escaping.

The object of the present invention is to provide an applicator device wherein the risk of the product which is to be applied from running out of the applicator is reduced.

SUMMARY OF THE INVENTION

According to the invention the object is attained wherein sealing means is independent of the increased pressure-producing means in a first portion of the path which is delimited by the first position.

In other words that portion of the path of the sealing means from the first position into the second position, in which the sealing means is coupled to the increased pressure-producing means, does not directly adjoin the first position. Rather, coupling of the sealing means to the increased pressure-producing means takes place only in a later portion of that path of movement, and for that reason no increased pressure is produced in the storage means as long as the ball is still urged into the ball holder by the sealing means in such a way that a gap opens between the ball and the ball holder. Rather, the increase in the pressure in the storage means takes place only when the sealing means has left the ball and the above-indicated gap is closed. That reduces the risk of the product which is to be applied running out.

In accordance with a preferred embodiment of the invention there is provided a screwthread for displacing the sealing means with respect to the casing. That configuration is mechanically particularly simple to embody.

Additionally or alternatively it is also possible to provide a bayonet connection.

In a further preferred feature there is provided a coupling means for coupling the sealing means to the increased pressure-producing means in the predetermined portion of the path of movement. Such a coupling means more specifically permits uncoupling in said first portion of that path.

In that case the coupling means preferably has a first coupling element at the sealing means and a second coupling element at the increased pressure-producing means, which can be coupled together by way of a frictional engagement and/or by way of a positively locking engagement.

In that case the two coupling elements can be provided integrally at the sealing means and at the increased pressure-producing means respectively or can be in the form of a separate portion and connected to said components.

The coupling means can have a ring of teeth at the increased pressure-producing means and/or at the sealing means.

In other words that configuration operates essentially with a positively locking connection.

Both such a positively locking connection and also a frictional connection can be designed in such a way that overall the arrangement affords a slipping clutch, for example in order to limit the increased pressure produced in the storage means.

Particularly in the case of the ring of teeth, it can be provided in accordance with the invention that the coupling means has at least one tooth-like projection on the sealing means and/or the increased pressure-producing means.

The ring of teeth and/or the tooth-like projection is/are preferably provided on a sleeve-like projection which preferably has at least one longitudinal slot.

That design configuration is preferred in comparison with a design configuration for example with three rings of teeth because coupling engagement takes place more easily.

In accordance with a particularly preferred feature of the invention it is provided that the increased pressure-producing means is controllable in such a fashion as to afford a reduction in the pressure in the storage means.

That is advantageous in particular in regard to non-leak security.

In accordance with a further preferred embodiment of the invention it is provided that the increased pressure-producing means has a transmission means with at least one female screwthread element and at least one male screwthread element, wherein the transmission means can assume at least two operating conditions, namely a first operating condition in which the two screwthread elements mesh with each other to produce the increased pressure, and a second operating condition in which they do not mesh with each other, thereby resulting in a reduction in the increased pressure.

In other words, in accordance with this preferred embodiment of the invention it is provided that two screwthread elements are coupled together to produce the increased pressure and are uncoupled to reduce the pressure in the storage means. That affords a solution which is particularly simple from the point of view of structure, inexpensive and easy to handle.

It can happen that a user of the applicator device forgets to reduce the pressure in the storage means after work has been done. In such a case, under some circumstances, the product which is to be applied can suffer damage in the storage means. In addition it is not possible to be sure that the product will not run out.

In accordance with a particularly preferred embodiment of the invention it is therefore provided that the applicator device can assume at least two operating conditions, namely a rest condition and a use condition, and has a means for reducing the pressure in the storage means, said pressure-reducing means being responsive to a movement of the applicator device from the use condition into the rest condition.

In other words, this configuration of the invention provides that the pressure in the storage means is automatically reduced as soon as the applicator device is moved into the rest condition, after its work has been done.

In that respect it can be provided that the applicator device is put into the rest condition by putting the sealing means into the first position with respect to the casing.

In other words, this configuration of the invention provides that putting the sealing means into the first position, that is to say into that position in which it bears sealingly against the ball, results in an automatic reduction in the pressure in the storage means.

BRIEF DESCRIPTION OF THE DRAWINGS

The invention is described in greater detail hereinafter by means of a preferred embodiment in the form of pencils with reference to the accompanying drawing in which.

DETAILED DESCRIPTION

Figure 1:
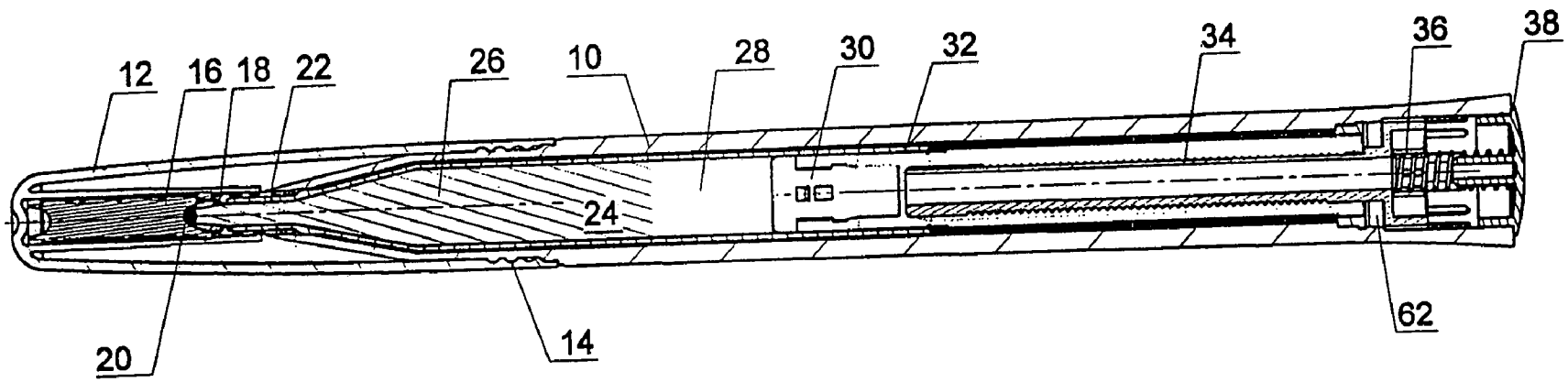
FIG. 1 is a view in longitudinal section of a pencil according to a particularly preferred embodiment of the invention.

Referring to FIG. 1, the pencil has an external shaft 10 which serves as a casing and on to which a cap 12 is screwed in the operating position shown in FIG. 1 (rest position). For that purpose there is a screwthread identified by reference numeral 14. The cap 12 has a seal 16 which sealingly embraces a tip 18 in the operating condition shown in FIG. 1. At the free end of the tip a ball 20 is held in a ball holder 21 against which the seal 16 sealingly bears.

The tip 18 is enclosed by a cartridge sleeve 22 at its end portion remote from the ball 20. The cap 12 is rotationally coupled to the sleeve 22 in portion-wise manner in a fashion described in greater detail hereinafter.

The internal space of the sleeve 22 forms a storage means 24 for ink 26. Arranged on the side remote from the ball 20 in the storage means 24 is a closure mass 28 which serves for sealing off in relation to the ambient atmosphere. The rear boundary of the storage means 24 is formed by a plunger 30. The plunger 30 is disposed slidably within the storage means 24. As seen from the ball, a plunger holder 32 is disposed behind the plunger 30. A control pushrod 34 projects into the plunger holder. A spring 36 bears on the one hand against the control pushrod 34 and on the other hand against a closure cap 38.

Figure 2:
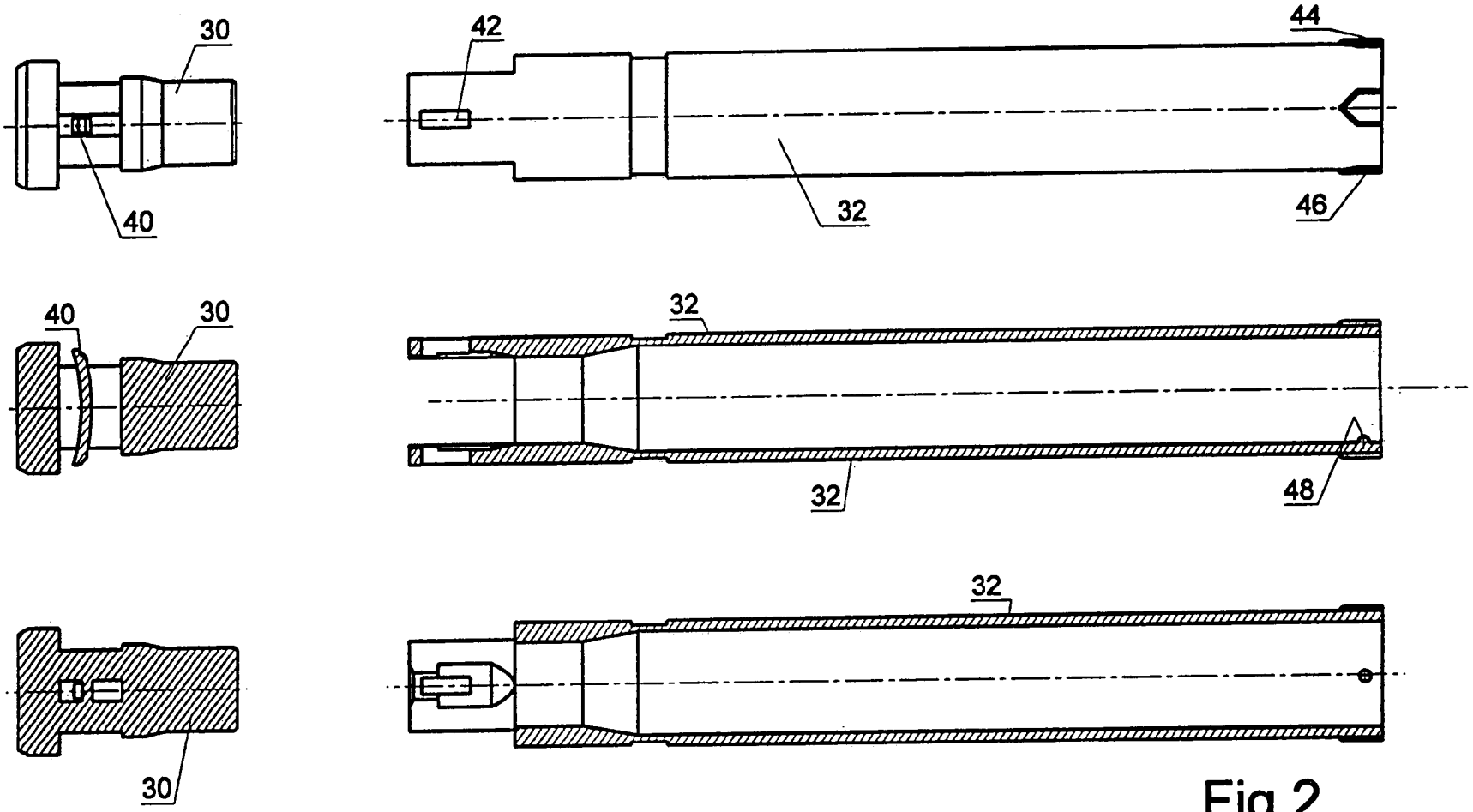
FIG. 2 shows views of a plunger arrangement of the pencil of FIG. 1.

As can be seen from FIG. 2 the plunger 30 has a projection 40 which in the assembled condition engages into a window 42 in the plunger holder 32. At its end portion remote from the plunger 30 the plunger holder 32 has projections 44 and 46 which engage into corresponding recesses in the cartridge shaft 22, for rotational coupling purposes. Accordingly the plunger holder 32 is admittedly rotationally coupled to the cartridge shaft 32 but it is held axially slidably therein.

Also at its end portion remote from the plunger 30 the plunger holder 32 is provided in its interior with a substantially hemispherical female screwthread element 48 which serves for coupling—at times—to the control pushrod 34.

The control pushrod 34 is provided with male screwthread elements which are complementary to the female screwthread element 48 and of which one is identified by way of example by reference numeral 50. The male screwthread elements 50 correspond to segments of a helicoidal groove and respectively extend over an angle of somewhat more than 300°. They are interrupted by a longitudinal groove 52 which extends over an angle of about 27°.

At its end portion remote from the wall 20 the control pushrod 34 is provided with projections 54, 56, 58 and 60 which engage into corresponding recesses in the external shaft 10 for rotational coupling purposes. The control pushrod 34 is however axially slidable with respect to the external shaft 10 between the closure cap 38 and an abutment 62. The function of the pencil illustrated in the drawing is as follows:

FIGS. 4 through 7 show various operating positions of the cap 12 with respect to the external shaft 10 serving as a casing.

As can be seen in particular from FIGS. 4 through 7, provided in the internal space of the cap 12 is a sleeve-shaped projection 66 which projects beyond the seal 16 and has at least one longitudinal slot 68. Provided on the inside of the projection 66 is a series of tooth-like projections of which one is identified by way of example by reference numeral 70.

The sleeve 22 carries a ring of teeth 72 which are matched to the tooth-like projections 70 on the projection 66.

Figure 4:
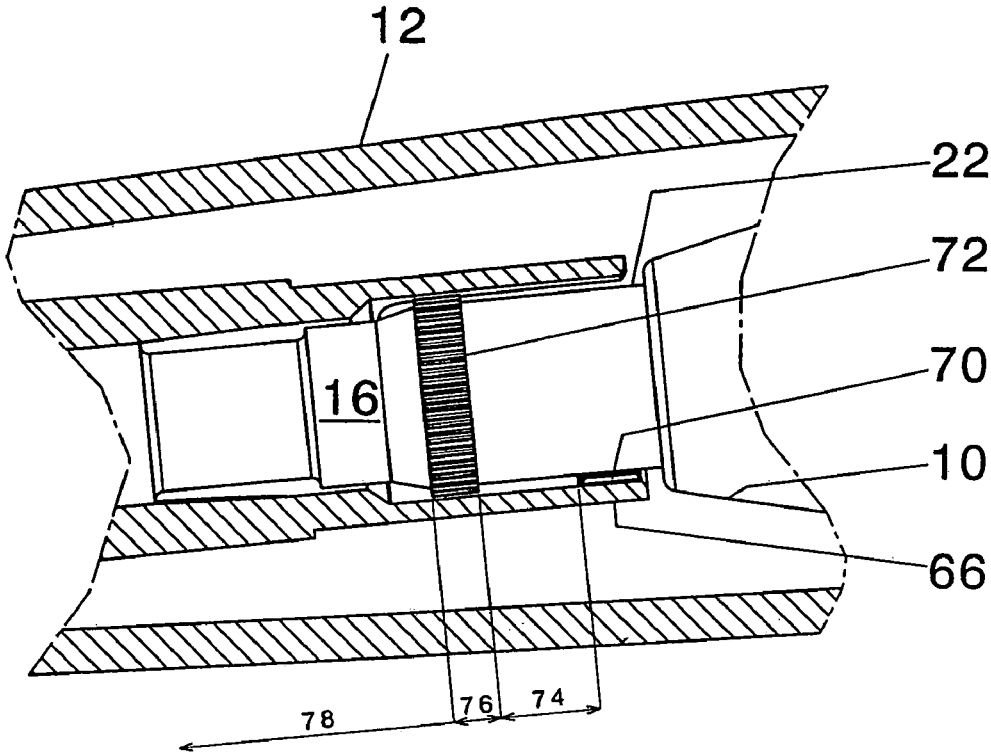
Figure 5:
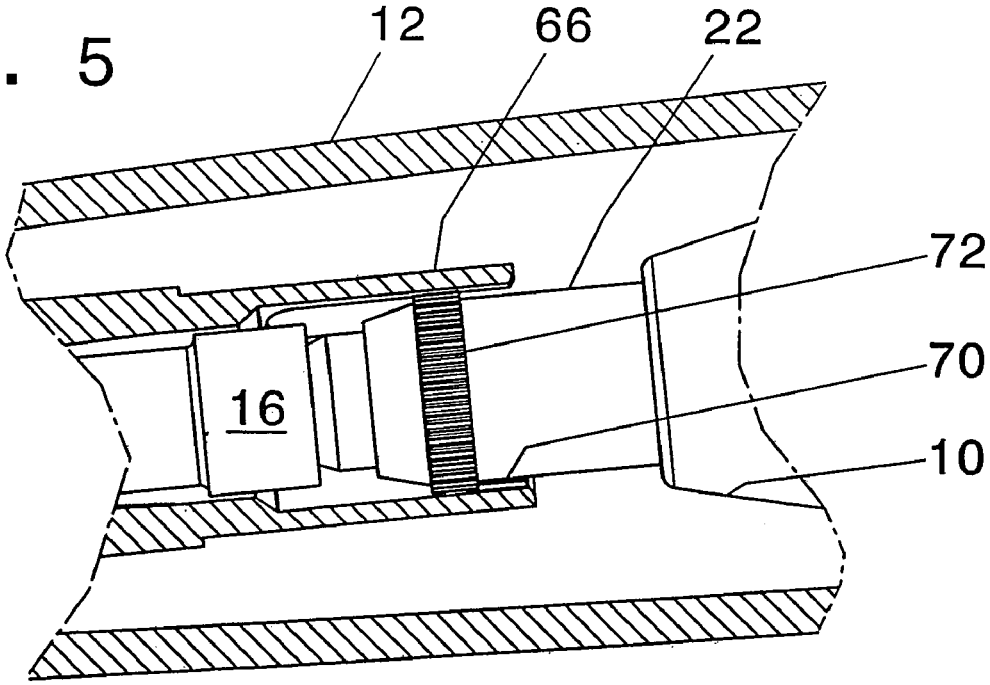

As already mentioned above, FIG. 1 shows the rest position of the pencil, that is to say that position in which the cap 12 is screwed on to the external shaft 10 serving as the casing, more specifically in such a way that the seal 16 bears sealingly against the ball 20. The same position (rest position) is also shown in FIG. 4. When now the cap 12 is unscrewed from the external shaft 10, the cap moves towards the left in FIG. 4. In a first portion 74 (FIG. 4) of that path of movement the tooth-like projections 70 are not in engagement with the ring of teeth 72, for which reason the sleeve 22 is not also rotated by the cap 12. Rather, the tooth-like projections 70 only come into engagement with the ring of teeth 72 in a later portion 76 of the path of the cap 12 from the rest position into the operative position. In that position the seal 16 has already lifted off the ball 20. That condition is shown in FIG. 5. Because of the engagement of the tooth-like projections 70 into the ring of teeth 72, the sleeve 22 now rotates with the cap 12.

Figure 6:
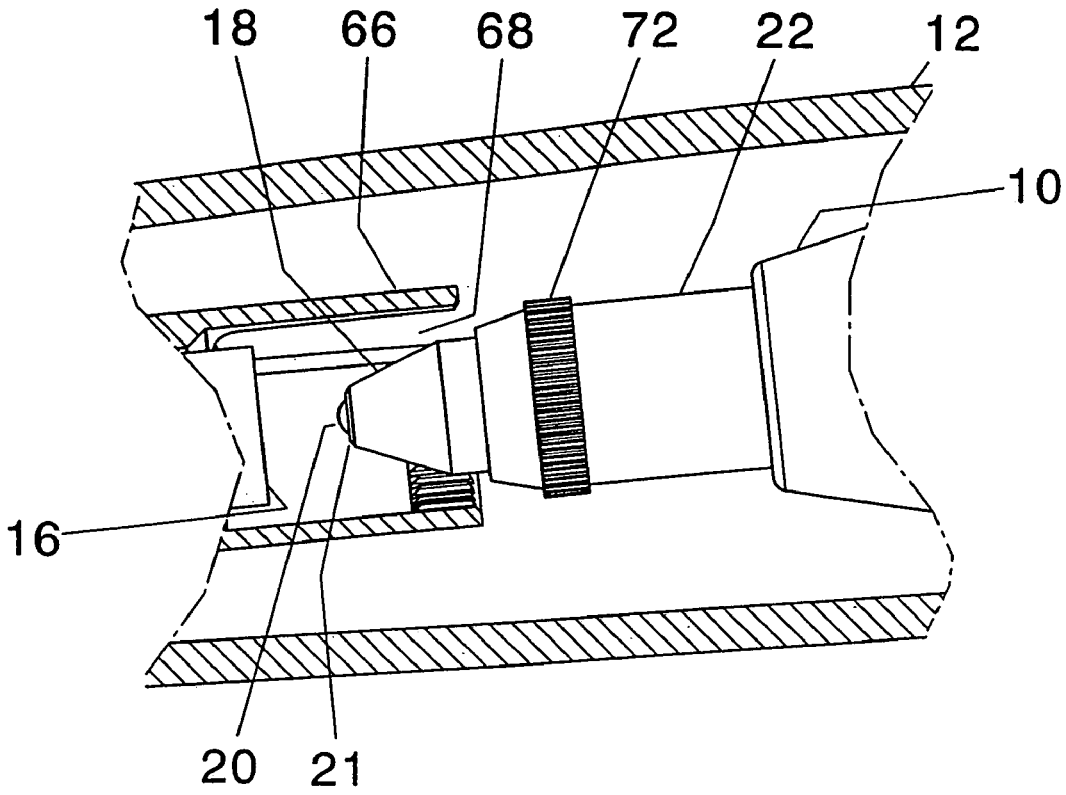
Figure 7:
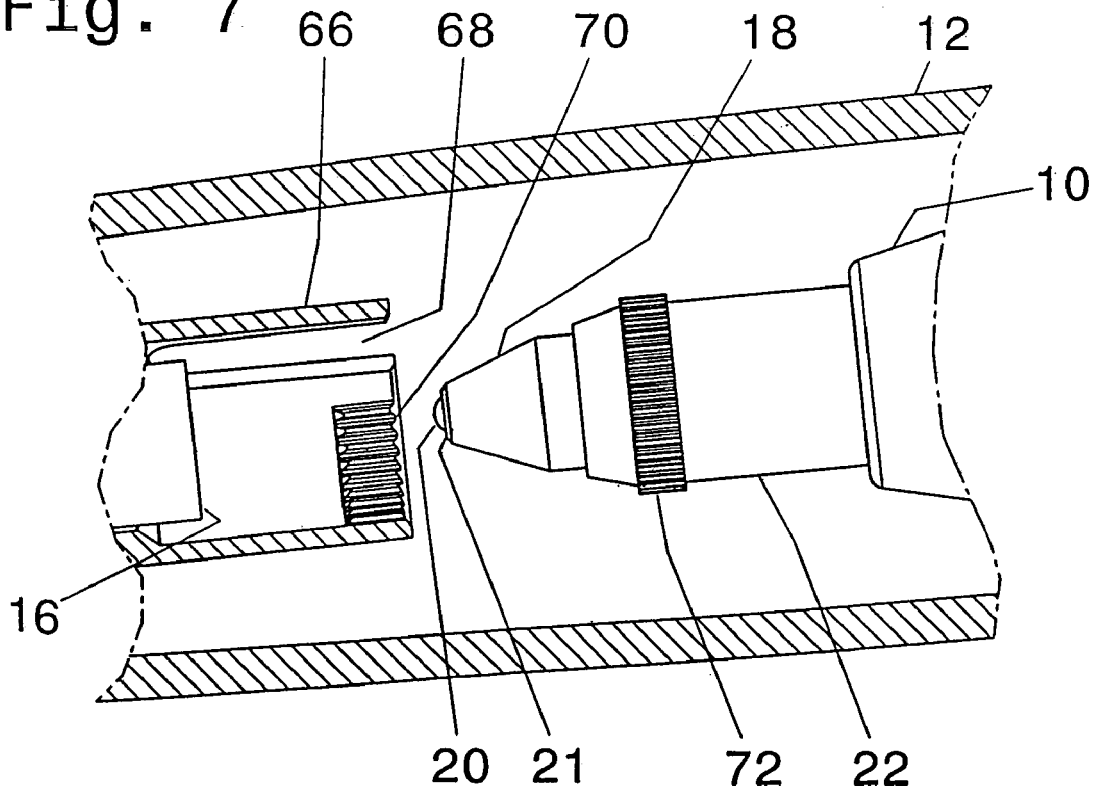
Figure 8:
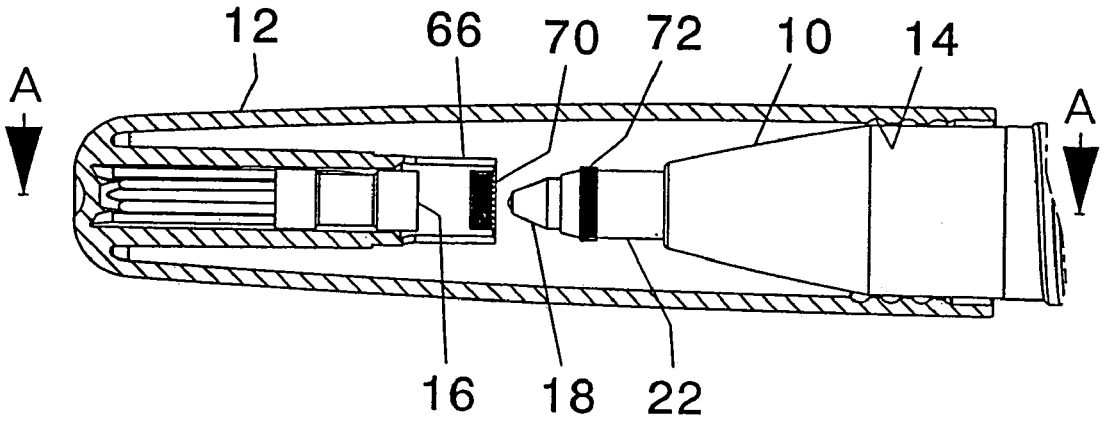
FIGS. 8 and 9 show diagrammatic views in section of the front portion of the pencil with the cap.
Figure 9:
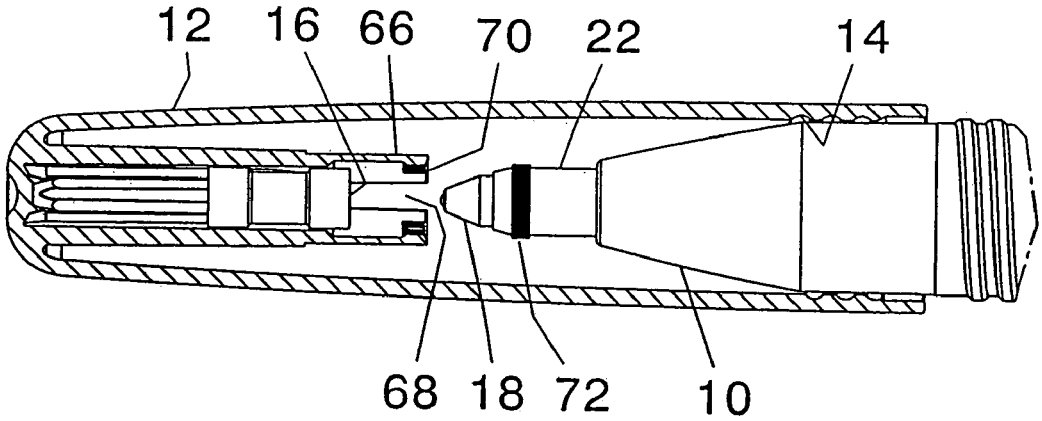

The portion 76 is adjoined by a portion 78 in which the tooth-like projections 70 have again left the ring of teeth 72, see FIGS. 6 and 7. In that operative position further rotation of the cap 12 with respect to the external shaft 10 does not cause any further rotational movement of the sleeve 22.

In the operating position shown in FIG. 1 (rest position), that is to say when the cap 12 is screwed on to the external shaft 10, the female screwthread element 48 is in the groove 52. Accordingly in that operating position there is no coupling between the control pushrod 34 and the plunger 30. The plunger 30 accordingly does not apply any pressure to the closure mass 28 or the ink 26.

When the cap 12 is rotated with respect to the external shaft 10 in order to unscrew it, then, because of the rotational coupling effect which is not yet present between the cap 12 and the sleeve 22, in the first portion 74 of the path of movement of the cap 12, the plunger holder 32 does not rotate. Rotary movement of the plunger holder 32 first takes place in the portion 76 of the path of movement of the cap 12, more specifically by virtue of the engagement of the tooth-like projections 70 into the ring of teeth 72. In the further course of the rotary movement the female screwthread element 48 leaves the groove 52 and passes into the male screwthread element 50. Further rotary movement in that condition means that the female screwthread element 48 travels along the male screwthread element 50, whereby the control pushrod 34 which hitherto has been supported against the projection 62 is displaced against the spring 36. As a result the elastic return force of the spring 36 acts by way of the control pushrod 34 on the plunger holder 32 and thus on the plunger 30, whereby the pressure in the storage means 24 rises. At its end the male screwthread element 50 is limited by an abutment 64 against which the female screwthread element 48 butts upon further rotary movement. In the embodiment illustrated in the drawing the dimensions are so selected that, with the female screwthread element 48 butting against the abutment 64, the cap 12 reaches the portion 78 in which the tooth-like projections 70 are no longer in engagement with the ring of teeth 12.

It is however not out of the question that production tolerances cause difficulty in accurate matching. The longitudinal slot 68 is accordingly provided. More specifically, if the female screwthread element 48 should butt against the abutment 64 while the tooth-like projections 70 are still in engagement with the ring of teeth 72, then the projection 66 can expand because of the longitudinal slot 68 so that the tooth-like projections 70 slip on the ring of teeth (slipping clutch) and therefore the tooth-like projections 70 and the ring of teeth 72 are not damaged.

The increased pressure which is now built up in the storage means 24 can be used for discharging the ink 26. The pencil is now in the operative position.

When, after use of the pencil, the cap 12 is screwed on to the external shaft 10 again, then the female screwthread element 48 travels along the male screwthread element 50 back into the groove 52 again, because of the coupling effects described in detail hereinbefore, in the portion 76. As a result, under the influence of the spring 36, the control pushrod 34 travels again towards the abutment 62 where it is supported. Accordingly the spring 36 no longer acts on the ink 26 by way of the plunger holder 32 and the plunger 30. In that condition there is no longer any increased pressure obtaining in the storage means 24, which is of great advantage in terms of protecting the ink 26 and the closure mass 28 by being gentle therewith and in regard to the anti-leakage safeguard.

When the cap 12 is screwed on to the external shaft 10 the plunger holder 32 is moved away from the ball 20 until the female screwthread element 48 passes into the groove 52. So that in that case the plunger 30 does not suck the ink out of the tip 18 the plunger 32 is in the form of a trailing plunger. More specifically the plunger holder 32 can move away from the ball 20 in accordance with the axial length of the window 42 without entrainment of the plunger 30.

In addition to or instead of the projection 40 in the window 42 it is also possible to provide an elastic coupling means between the plunger holder 42 and the plunger.

The elastic coupling means and/or the play can however also be connected elsewhere between the control pushrod 34 and the plunger surface which delimits the storage means 24.

Figure 3:
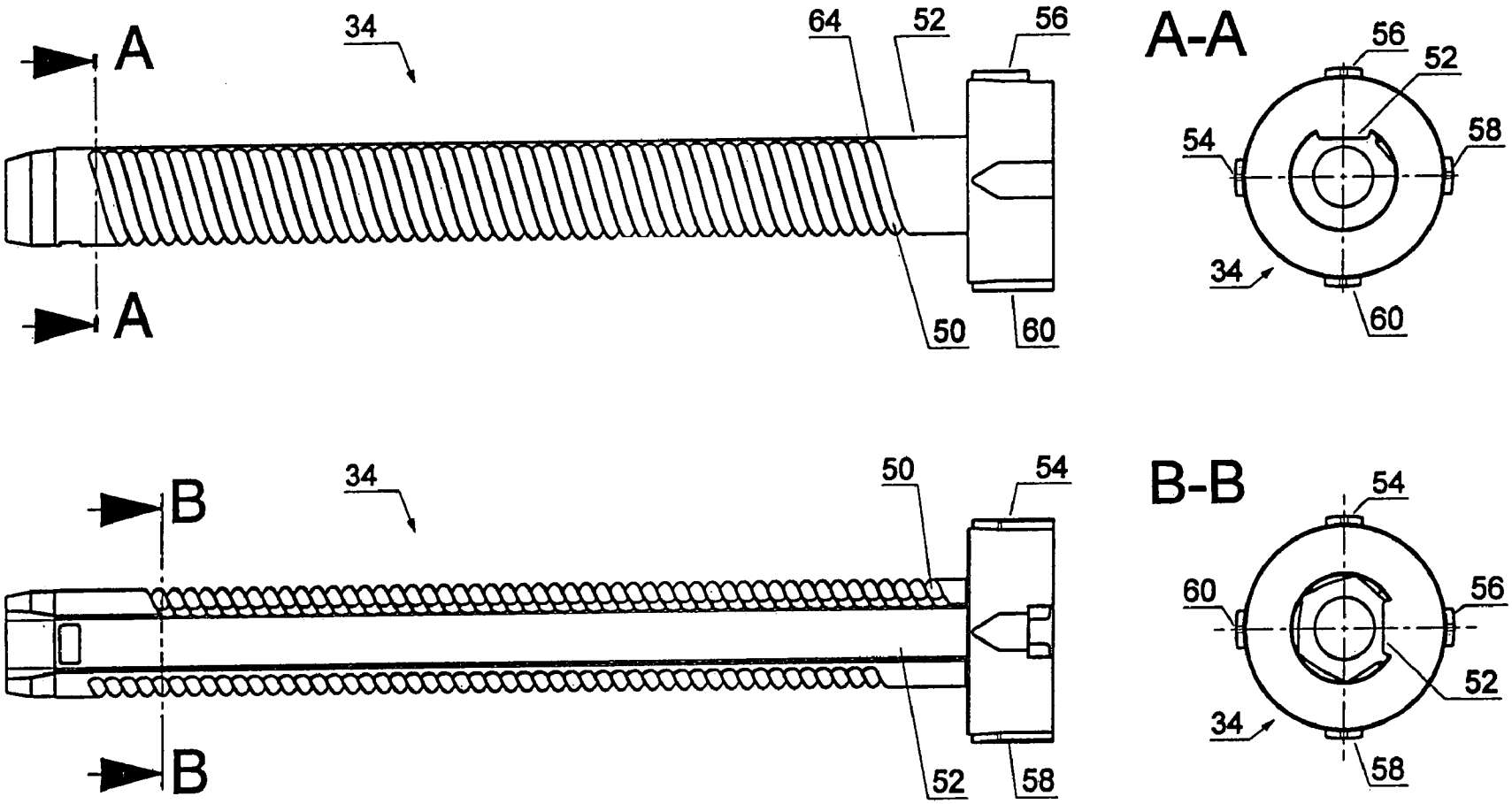
FIG. 3 shows views of a control pushrod of the pencil of FIG. 1, FIGS. 4 through 7 show diagrammatic views in section relating to the co-operation of a cap with the pencil.

The rotary transmission means shown in FIGS. 1 through 3 can compensate for a reduction in the filling level in the storage means 24. More specifically, with a reducing filling level the plunger holder 32 moves together with the plunger 30 gradually into the storage means 24 whereas the control pushrod 34 does not change its position relative to the spring 36 in accordance with the filling level, for which reason the same return force is always available for producing the increased pressure.

The closure cap 38 can be held resiliently in the manner of a shock absorber. The spring 36 serves for that resilient holding effect, that is to say that elastic element whose return force serves to produce the increased pressure in the storage means 24. That configuration thereby provides for minimising the number of components involved.

The features of the invention disclosed in the foregoing description, the claims and the drawing can be essential both individually and also in any combinations for implementing the invention in the various embodiments thereof.

The invention claimed is:

1. An applicator device comprising a casing (10), a storage means (24) for a product (26) to be applied, an application means comprising a ball (20) held rotatably in a ball holder (21), a sealing means (16) which is displaceable along a predetermined path (74, 76, 78) between a first position with respect to the casing (10) in which it bears sealingly against the ball (20) and a second position with respect to the casing (10) in which it releases the ball (20) for application of the product (26), and an increased pressure-producing means (22, 30, 32, 34, 36) for producing an increased pressure in the storage means (24), wherein the sealing means (16) is coupled in a predetermined portion (76) of the path (74, 76, 78) to the increased pressure-producing means (22, 30, 32, 34, 36), wherein the sealing means (16) is independent of the increased pressure-producing means (22, 30, 32, 34, 36) in a first portion (74) of the path (74, 76, 78) which is delimited by the first position.

2. An applicator device as set forth in claim 1, further comprising a screwthread (14) for displacing the sealing means (16) with respect to the casing (10).

3. An applicator device as set forth in claim 1, further comprising a bayonet connection for displacing the sealing means (16) with respect to the casing (10).

4. An applicator device as set forth in claim 1, further comprising a coupling means (70, 72) for coupling the sealing means (16) to the increased pressure producing means (22, 30, 32, 34, 36) in the predetermined portion (76) of the path of movement (74, 76, 78).

5. An applicator device as set forth in claim 4, wherein the coupling means (70, 72) has a first coupling element (70) at the sealing means (16) and a second coupling element (70) at the increased pressure-producing means (22, 30, 32, 34, 36), said coupling elements are coupled together by way of a frictional engagement and/or a positively locking engagement.

6. An applicator device as set forth in claim 4, wherein the coupling means (70, 72) has a ring of teeth (72) at the increased pressure-producing means (22, 30, 32, 34, 36) or at the sealing means (16).

7. An applicator device as set forth in claim 6, wherein the ring of teeth (72) is provided on a sleeve-like projection (66).

8. An applicator device as set forth in claim 7, wherein the sleeve-like projection (66) has at least one longitudinal slot (68).

9. An applicator device as set forth in claim 4, wherein the coupling means (70, 72) has at least one tooth-like projection (70) at the sealing means (16) or at the increased pressure-producing means (22, 30, 32, 34, 36).

10. An applicator device as set forth in claim 1, wherein the increased pressure-producing means (22, 30, 32, 34, 36) comprises means to produce a fall in the pressure in the storage means (24).

11. An applicator device as set forth in claim 1, wherein the increased pressure-producing means (22, 30, 32, 34, 36) comprises a transmission means with at least one female screwthread element (48) and at least one male screwthread element (50), wherein the transmission means can assume at least two operating conditions, namely a first operating condition in which the two screwthread elements (48, 50) mesh with each other to produce the increased pressure, and a second operating condition in which they do not mesh with each other, a fall in the increased pressure resulting therefrom.

12. An applicator device as set forth in claim 1, wherein the increased pressure-producing means assumes at least two operating conditions, namely a rest condition and a use condition, and has a means (16, 22, 30, 32, 34, 36, 70, 72) which is responsive to the applicator device being moved from the use condition into the rest condition, for reducing the pressure in the storage means (24).

13. An applicator device as set forth in claim 12, wherein the increased pressure-producing means assumes the rest condition by the sealing means (16) being put into the first position with respect to the housing (10).

* * * * *